United States Patent [19]

Nobuta et al.

[11] Patent Number: 4,727,803

[45] Date of Patent: Mar. 1, 1988

[54] CONVEYOR DEVICE WITH AN ARTICLE LIFTING UNIT

[75] Inventors: Yousuke Nobuta; Kouichi Yamashita, both of Kanagawa, Japan

[73] Assignee: Kabushikikaisha Tokyo Kikai Seisakusho, Tokyo, Japan

[21] Appl. No.: 893,702

[22] Filed: Aug. 6, 1986

[51] Int. Cl.[4] ..... B65B 13/18

[52] U.S. Cl. ..... 100/7; 100/18; 100/26; 100/49; 198/493; 271/69; 271/212

[58] Field of Search ..... 198/468.8, 493, 858, 198/857; 271/212, 69; 100/7, 26, 49, 17, 18; 112/121.11, 304

[56] References Cited

U.S. PATENT DOCUMENTS

| | | | |
|---|---|---|---|
| 2,975,885 | 3/1961 | Grundelman | 198/493 |
| 3,108,679 | 10/1963 | Woody | 198/468.8 |
| 3,126,938 | 3/1964 | McCoy | 198/468.8 |
| 3,901,138 | 8/1975 | Bilt | 100/14 X |
| 4,256,032 | 3/1981 | Davis | 100/26 |
| 4,362,116 | 12/1982 | Gupta et al. | 112/121.11 X |

FOREIGN PATENT DOCUMENTS

| | | | |
|---|---|---|---|
| 550768 | 1/1943 | United Kingdom | 198/493 |

OTHER PUBLICATIONS

IBM Technical Disclosure Bulletin, vol. 23, No. 11, 4/1981, Walker, L. A., Cam-Lifting Device.

*Primary Examiner*—Andrew M. Falik

*Attorney, Agent, or Firm*—Schwartz, Jeffery, Schwaab, Mack, Blumenthal & Evans

[57] ABSTRACT

A conveyor apparatus has a conveying member on which an article such as a bundle of newspapers to be conveyed is laid, a driving device for driving the conveying member, and a lifting device to lift the article so as to separate at least a part of the article from the surface of the conveying member. Thyis lifting device is located near by the tail end of the conveyor member. This lifting device consists of a mechanical lifting unit or a pneumatic lifting unit, or the combination of them. This lifting device is actuated in accordance with a signal from a sensor for detecting the article.

13 Claims, 8 Drawing Figures

CONVEYOR DEVICE WITH AN ARTICLE LIFTING UNIT

BACKGROUND OF THE INVENTION (1) Field of the Invention

The present invention generally relates to a conveyor device. More particularly, the present invention relates to a conveyor device for flexible articles such as a bundle of printed matters or newspapers.

(2) Description of the Prior Art

In a printing factory numerous conveyor devices have been employed to move printed material which undergoes a stacking process, a wrapping process, a strapping process, a distributing process and so on.

For example, in a newspaper printing factory, printed and folded papers are counted and stacked in a counting and stacking device following their passage through a folding device of a printing press. The stacked papers are bundled into one sheaf. These bundled papers are forcibly transferred by a conveyor device moving at a predetermined speed and for a predetermined direction. This conveyor device is arranged at the inlet and outlet sections of several devices such as a wrapping device, a strapping device, a distributing device and so on. Thus the bundled papers are subjected to required processing and/or checked prior to bundled distribution.

FIG. 7 is a perspective view showing a typical conventional conveyor device 2. This device comprises a plurality of rollers 21, 21*a* arranged in parallel with each other, a plurality of top plates 4 interposed between the rollers, and a plurality of conveying members 22 in a belt, wire, or chain shape. The conveying members 22 are bridgingly extended between the rollers and the sections between them are supported by the top plates 4. When, the rollers 21*a* are driven by a driving mechanism in the same direction, the conveying members 22 move together in the same direction. An article laid on the conveying members 22 also moves due to the friction between the conveying members 22 and the article.

As shown in FIG. 7 and FIG. 8, in a conventional conveyor device, the conveying members 22 are so arranged as to allow a continuity of the conveyor device. In detail, one conveying member 22 is bridgingly extended between a single roller 21 and one of dual rollers 21*a*. The adjacent conveying member, in the vertical direction in FIG. 8, is bridged between a single roller 21 and another roller of the dual rollers 21*a*. Further, in the horizontal direction in FIG. 8, the conveying members 22 of the forwarding conveyor unit and that of the following conveyor unit are assembled on the identical roller represented by an arrow B in order to make a continuous conveyor line. However, a discontinuous space indicated by an arrow A in FIG. 7 is required for a strapping device to apply a strapping member around an article moving on the conveyor.

If the moving article is a flexible substance such as a bundle of newspapers, this conventional conveyor device may cause problems when the moving article is subjected to a large force (e.g., forces resulting from entanglement of loose bundling straps) other than the friction force between the article and the conveying member. Since the thickness of a bundle of newspapers is not constant, since the number of newspapers to be sent depends on each delivery station or the like, some bundles consisting of an extremely small number of newspapers have to be wrapped and delivered. Such bundles are too flexible to stretch the strapping member, so that the loose strapping member may become pendent. This pendent strapping member may be easily entangled in the roller, the conveying member, or the other elements of the conveyor device at the discontinuous space between the conveyor units, or the conveyor device and the other devices such as transfer device, distributing device, loading device, delivery device, or the like. This could cause the moving article to injure personnel, drop from the conveyor line, or in the extreme case, cause the conveyor line to stop.

SUMMARY OF THE INVENTION

It is an object of the present invention to provide a conveyor device free from the above described problems.

Another object of the present invention is to provide a conveyor device which can convey a thin and flexible substance with a simple structure.

To accomplish the above objects, the conveyor device according to the present invention comprises a conveying member on which an article to be conveyed is laid, a driving means for driving the conveying member, and a lifting means to lift the article to be conveyed so as to separate at least a part of the article from the surface of the conveying member. This lifting means consists of a mechanical lifting mechanism or a pneumatic injection mechanism or combination thereof. This lifting means is located near by the tail end of the conveyor device so that the article can be lifted and separated from the conveying member of the conveyor device. This lifting means is actuated in accordance with a signal from a sensor for detecting the article.

According to the above mentioned structure, the sensor can detect the forward end of the article conveyed by the conveying member and output a start signal to the lifting means. The lifting means is actuated in response to the signal so that the lifting means lifts the moving article. Even if the article is a thin flexible substance, the article can smoothly cross the discontinuous space between the conveyor units, or the conveyor device and the other devices owing to the lifting function of the lifting means.

Other objects, features and advantages of the present invention will become apparent upon perusal of the following detailed description of the preferred embodiments of the present invention when taken in conjunction with the appended drawings.

DETAILED DESCRIPTION OF THE PREFERRED EMBODIMENT

Preferred embodiments of this invention will be explained with referring to the accompanying drawings.

Figure 1:
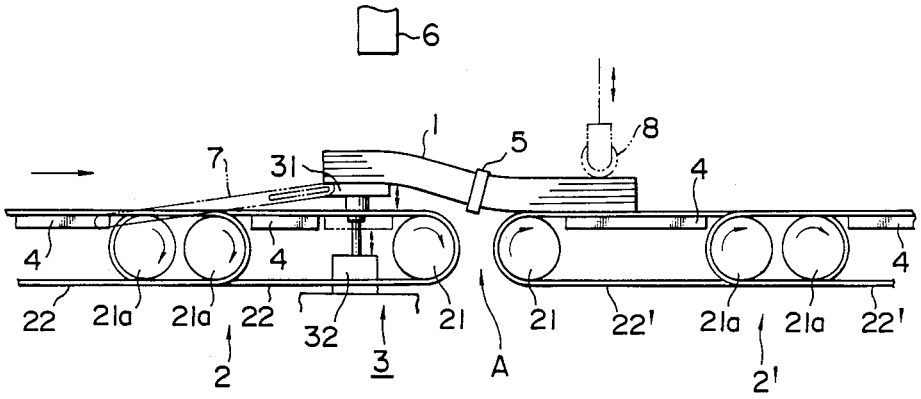
FIG. 1 is a schematic side view showing a first embodiment of the conveyor device according to the present invention.

FIG. 1 is a schematic side view of a first embodiment of the conveyor device according to the present invention.

In the drawing, the reference numeral 1 denotes an article to be conveyed, in this embodiment a bundle of printed papers such as a newspaper. This article is strapped at a substantial center thereof by a strapping member 5 such as band, tape, and the like.

The reference numeral 2 denotes a conveyor device. This conveyor device 2 comprises a plurality of rollers 21, 21*a* arranged parallel to each other, a plurality of top plates 4 interposed between the rollers, and a plurality of conveying members 22 in a belt, wire, or chain shape. In this embodiment, a plurality of belts is bridgingly extended between the rollers. The rollers are rotatably set and some of rollers are driven by a driving mechanism, not shown. The reference numeral 2' denotes a following conveyor device comprising the substantially same construction as the forward conveyor device 2.

The reference numeral 3 denotes a lifting means disposed near by the tail end of the conveyor device 2. In detail, the forward conveyor device 2 and the following conveyor 2' are connected through a discontinuous space A. The lifting means 3 is located immediately before this space A.

In FIG. 1, this lifting means 3 comprises a lifting member 31 such as a plate shape member and a driving means 32 for lifting the lifting member 31.

Figure 2:
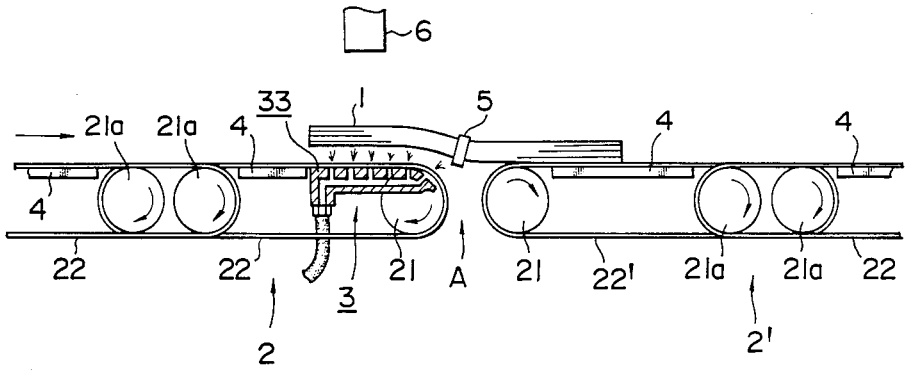
FIG. 2 is a schematic side view showing a modification of the first embodiment of the conveyor device according to the present invention.
Figure 3:
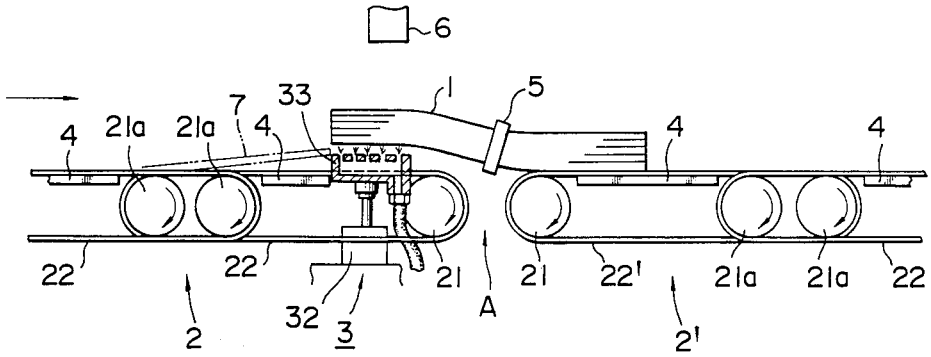
FIG. 3 is a schematic side view showing another modification of the first embodiment of the conveyor device according to the present invention.

This lifting means 3 may be modified as shown in FIG. 2 and FIG. 3. In FIG. 2, the lifting means 3 employes a pneumatic lifting unit. In detail, the lifting means 3 comprises a plurality of air injection nozzles 33 so arranged as to inject high pressure air upwards vertically and upwards at an angle inclined from the vertical.

In FIG. 3, another modification of the lifting means 3 comprises a combination of the mechanical lifting unit 32 shown in FIG. 1 and the pneumatic lifting unit 33 such as air injection nozzles shown in FIG. 2. The pneumatic lifting unit 33 is lifted by the mechanical lifting unit 32 and further the high pressure air is injected upwards from the nozzles 33.

Returning to FIG. 1, a sensor 6 is located above the lifting means 3. In this embodiment, the sensor 6 is a photoelectric tube. Another type sensor such as a limit switch, air sensor, or the like may be also employed. The sensor 6 contains a timer which is actuated when the sensor 6 detects the forward end of the article 1. The timer outputs a signal to the lifting means 3 after a predetermined timing period which is based on the time required for the forward end of the article to completely cross discountinuous space A and depends on a moving speed of the conveyor member 22, length of the article 1, and a dimension of the discontinuous space A. In other words, the lifting means 3 is not actuated until the forward end of the article 1 has completely crossed the space A and engaged with the conveying member 22' of the following conveyor device 2' where the article 1 can be conveyed by the conveying member 22'. The lifting means 3 is kept in its lifted position for a predetermined period depending on the above factors so as to allow the rear end of the article 1 to cross the space A completely. The timer outputs a return signal to the lifting means 3 after the predetermined period, so that the lifting means 3 is returned to its initial position.

On the other hand, the sensor 6 may be disposed at a little shorter distance than the half length of the article 1 downstream from the space A. This sensor 6 detects the forward end of the article 1 and outputs this detected signal to the lifting means 3. According to this signal, the lifting means 3 is actuated. Then the sensor 6 outputs a rear end detecting signal to the lifting means 3, so that the lifting means 3 is returned to its initial position.

The reference numeral 7 denotes a collision preventing means for preventing the lifting means 3 in lifting position from colliding with the following article. This collision preventing means 7 is disposed before the lifting member 31 and raised in synchronism with the mechanical lifting unit 32. This raised position is represented by a clashed line in FIG. 1. This collision preventing means 7 is also required for the systems shown in FIG. 3 and FIG. 5. The pneumatic lifting unit 33 shown in FIG. 2 does not need this collision preventing means 7.

The reference numeral 8 denotes a holding means disposed near by the forward end of the following conveyor device 2'. In this embodiment, this holding means 8 mainly consists of a vertically movable elastic roller to flexibly press the article to the conveying member 22'. The pressure of this roller 8 is so set that the movement of the article 1 is not restrained by this roller 8. In this embodiment, the rear half section of the article 1 is separated from the conveying member 22 of the forward conveyor device 2 by the lifting operation, and the article 1 is pulled by the friction between the conveying member 22' of the following conveyor device 2' and the front half section of the article 1. Therefore, this holding means 8 is effective. To increase the friction, the surface of the conveying member 22' may be changed to a configuration having greater coefficient of contact friction compared with that of the conveying member 22 of the forward conveyor device 2.

An operation of this conveyor device will be explained as follows.

A bundle of newspapers, the article 1 to be conveyed, is conveyed by a series of conveyor devices. As the forward end of the newspapers 1 has passed below the sensor 6, the timer included in the sensor 6 starts to count. After the timer has counted for a predetermined period, the sensor 6 outputs an actuating signal to the lifting means 3. The driving means 32 of the lifting means 3 is actuated, so that the lifting member 31 rises. The rear half section of the newspaper bundle 1 is forcibly isolated from the conveying member 22 so as to make the strapping member 5, which may be hanging loosely higher than the surface level of the conveying member 22. The article 1 is forcibly pulled owing to the friction between the conveying member 22' of the following conveyor device 2' and the forward half section of the article 1. The strapping member 5 can cross the discontinuous space A without becoming tangled with the rollers 21 and the conveying members 22. When the rear end of the article 1 has completely crossed the space A, the lifting means 3 is returned to its initial position. The collision preventing means 7 is also lifted upwards and returned to its initial position in synchronism with the lifting and returning motion of the lifting means 3.

In the case of pneumatic lifting means as shown in FIG. 2, a plurality of air injection nozzles injects a high pressure air upwards in accordance with the signal from the sensor 6. The article 1 is forcibly lifted by the high pressure air so that the strapping member 5 does not become tangled with the rollers 21 or the moving elements of the conveyor device 2.

In the case of the combination of pneumatic lifting means and mechanical lifting means as shown in FIG. 3, the air injection nozzle unit 33 is lifted by the mechanical lifting means 32 in response to the actuating signal from the sensor 6. The article 1 is forcibly lifted by the lifting motion of the mechanical lifting means 32 and the high pressure air injected through the nozzles 33, so that the strapping member 5 can cross the discontinuous space A without any trouble.

Figure 4:
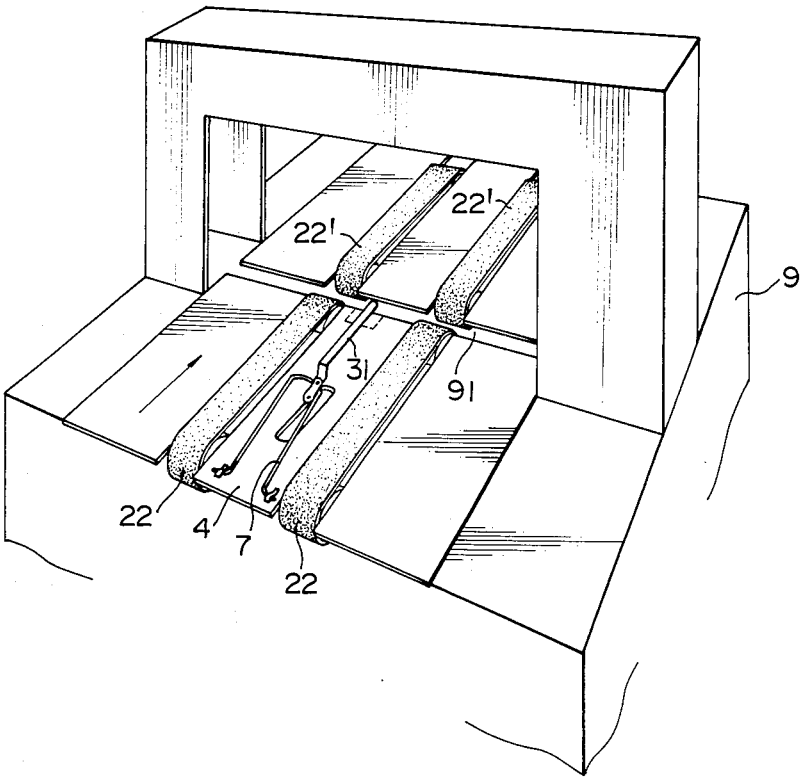
FIG. 4 is a perspective view showing a second embodiment of the conveyor device according to the present invention which is combined with a strapping device.
Figure 5:
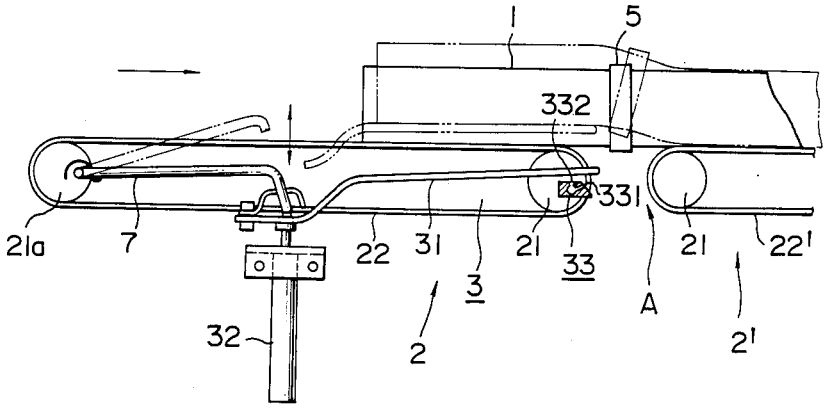
FIG. 5 is a schematic side view showing the conveyor device employed in FIG. 4.
Figure 6:
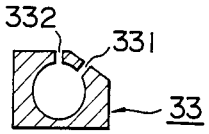
FIG. 6 is a sectional view showing a pneumatic injection element used in the device shown in FIG. 5.
Figure 7:
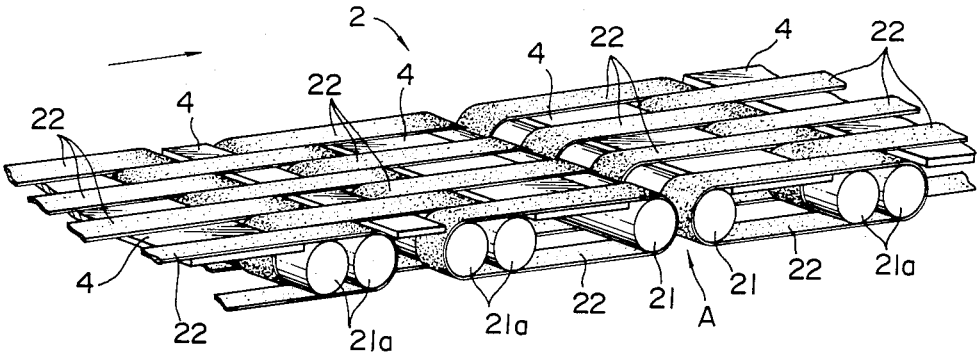
FIG. 7 PRIOR ART
FIG. 7 is a perspective view showing a conventional conveyor device.
Figure 8:
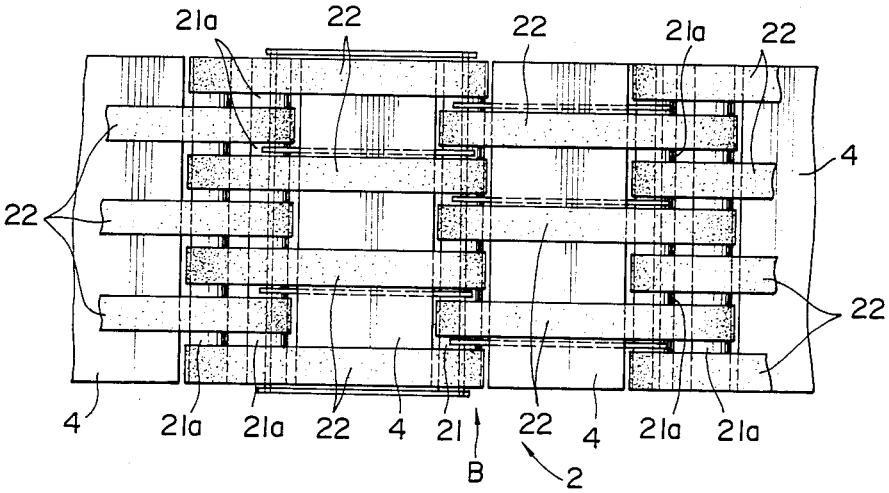
FIG. 8 PRIOR ART
FIG. 8 is a plan view showing another conventional conveyor device.

Referring to FIG. 4, there is shown a second embodiment of the conveyor device according to the present invention which is combined with a strapping device. FIG. 5 is a schematic side view showing the essential section of the conveyor device. FIG. 6 is a sectional view showing a pneumatic injection element used in the device. In this second embodiment, the same numerals denote the same or corresponding elements of the first embodiment, therefore the same explanation is not repeated.

A strapping device 9 comprises two set of conveyor units 2 and 2' and a strapping member supplier 91. This strapping member supplier 91 is located in a discontinuous space A between the forward conveyor unit 2 and the following conveyor unit 2'. A sensor, not shown, is arranged at a distance corresponding to the half length of an article 1 to be conveyed downstream from the discontinuous space A. The sensor detects the forward end of the article 1 and outputs a stop signal to the conveyor devices 2 and 2'. The conveyor devices 2 and 2' stop their conveying motion. On this occasion, a strapping member 5 is fit on the approximate center of the article 1. After this strapping operation, the conveyor devices 2 and 2' are automatically started so as to convey the strapped article 1.

The conveyor device 2 (2') is constituted in the essentially the same way as the conveyor device in the first embodiment except that a lifting means 3 is composed of a mechanical lifting member 31 and a pneumatic lifting member 33 which are separately arranged.

The lifting member 31 is arranged under the conveying member 22 when a driving unit 32 consisting of an air cylinder is not actuated. As the driving unit 32 is actuated, the lifting member 31 and a collision preventing member 7 are simultaneously moved upwards as represented by phantom lines in FIG. 5.

The pneumatic lifting member 33 is an air injector having two direction injection nozzles 331 and 332 as shown in FIG. 6. This air injector 33 is supplied with high pressure air from a control valve (not shown) such as an electromagnetic valve which can be actuated in synchromism with the driving member 32. The high pressure air is injected vertically upward and inclined upward through the nozzles 332 and 331 toward the bottom of the article 1. This lifting means 3 is actuated whenever the strapping operation has been completed.

An operation of this strapping device 9 will be explained as follows.

A stacked article 1 is conveyed by the conveying member 22 of the forward conveyor unit 2 and crosses the discontinuous space A. The stacked article 1 is pulled by the conveying member 22' of the following conveyor unit 2' and the sensor detects the forward end of the stacked article 1. The forward and following conveyor units 2 and 2' are stopped in accordance with the stop signal from the sensor. Then a strapping member supplier 91 provides a strapping member 5 to the center of the stacked article 1 and fixes it thereon. After this strapping operation, the conveyor units 2 and 2' are automatically actuated. On the same occasion, the driving unit 32 and the control valve of the pneumatic lifting means 33 are actuated, so that the lifting member 31 and the collision preventing means 7 rise and the high pressure air is injected toward the bottom of the article 1. The article 1 can smoothly cross the discontinuous space A owing to the combination of the mechanical lifting motion and the pneumatic lifting motion. Even if another article following this article 1 is immediately conveyed, the collision preventing means 7 can prevent the following article from colliding directly with the lifting member 31.

Although the following conveyor unit 2' is not provided with the lifting means 3 in this embodiment, it is needless to state that the similar means can be suitably arranged as needed.

It should be appreciated while various embodiments of the present invention have been described in specific detail, numerous additions, omissions and modifications are possible within the intended spirit and scope of the invention.

What is claimed is:

1. A conveying device comprising:
(a) a conveying member which on a first article to be conveyed is placed;
(b) means for driving the conveying member;
(c) means for sensing an end of an article on the conveying member;
(d) mechanical means for lifting the first article to separate a part of the article from a surface of the conveying member, the lifting means located substantially under an end of the said conveying member;
(e) means for raising the lifting member vertically in response to a signal from the sensing means, and
(f) a collision preventing member located along the conveying member before the lifting means, the collision preventing member actuated synchronously with the lifting member so as to prevent the lifting member from colliding with a second conveyed article which follows said first conveyed article.

2. A conveyor device according to claim 1, wherein the sensing means comprises a photoelectric tube.

3. A conveyor device according to claim 1, wherein the sensing means comprises a limit switch.

4. A conveyor device according to claim 1, wherein the sensing means comprises an air sensor.

5. A conveying device comprising:
(a) a conveying member which on a first article to be conveyed is placed;
(b) means for driving the conveying member;
(c) means for sensing an end of an article on the conveying member;
(d) the combination of a mechanical lifting unit and a pneumatic lifting unit, the combination having an air injector and forming a means for lifting the first article to separate a part of the article from a surface of the conveying member, the lifting means located substantially under an end of the conveying member;

(e) means for raising the lifting member vertically in response to a signal from the sensing means, and (f) a collision preventing member located along the conveying member before the lifting means, the collision preventing member actuated synchronously with the lifting member so as to prevent the lifting member from colliding with a second conveyed article which follows said first conveyed article.

6. A conveying device according to claim 5, wherein the pneumatic lifting unit comprises an air injector with a plurality of injection nozzles which are so arranged as to inject a high pressure air toward a bottom of the article.

7. A conveyor device according to claim 5, wherein the sensing means comprises a photoelectric tube.

8. A conveyor device according to claim 5, wherein the sensing means comprises a limit switch.

9. A conveyor device according to claim 5, wherein the sensing means comprises an air sensor.

10. A conveying device comprising:

a first conveying member on which an article to be conveyed is laid and a second conveying member associated with a strapping device located adjacent the end of the first conveying member;

a driving means for driving the first conveying member;

a lifting means located near said end of the first conveying member to lift the article upwards so as to separate a part of the article from the surface of the first conveying member so that the article is smoothly transferred to the second conveying member.

11. A conveyor device according to claim 10 in which the article to be conveyed is flexible.

12. A conveyor device according to claim 10 in which the conveying member is comprised of a plurality of belt shaped members.

13. A conveyor device comprising:

a conveying member on which an article to be conveyed is laid;

a driving means for driving the conveying member;

a lifting means located near by an end of the conveying member, to lift the article upwards so as to separate a part of the article from the surface of the conveying member; and, wherein the lifting means is actuated to lift the article in response to a start signal from a sensor which detects one end of the article, and the lifting means is deactuated in accordance with a return signal from the sensor, the sensor further comprising a timer which outputs said return signal after a predetermined time period to the lifting means.

* * * * *